US007733026B2

(12) United States Patent
Hebbinghaus et al.

(10) Patent No.: US 7,733,026 B2
(45) Date of Patent: Jun. 8, 2010

(54) LAMP WITH AN IMPROVED LAMP BEHAVIOUR

(75) Inventors: Gerhard Hebbinghaus, Julich (DE); Jozef Merx, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 580 days.

(21) Appl. No.: 11/571,757

(22) PCT Filed: Jul. 1, 2005

(86) PCT No.: PCT/IB2005/052194

§ 371 (c)(1), (2), (4) Date: Jan. 8, 2007

(87) PCT Pub. No.: WO2006/006109

PCT Pub. Date: Jan. 19, 2006

(65) Prior Publication Data

US 2008/0297052 A1 Dec. 4, 2008

(30) Foreign Application Priority Data

Jul. 6, 2004 (EP) ..... 04103196

(51) Int. Cl.

| | |
|---|---|
| ***H01J 61/073*** | (2006.01) |
| ***H01J 61/12*** | (2006.01) |
| ***H01J 61/36*** | (2006.01) |
| ***H01J 61/82*** | (2006.01) |

(52) U.S. Cl. ..... 313/631; 313/633; 313/620; 313/638

(58) Field of Classification Search ..... None
See application file for complete search history.

(56) References Cited

U.S. PATENT DOCUMENTS

| | | | | |
|---|---|---|---|---|
| 6,483,237 | B2 * | 11/2002 | Eastlund et al. | 313/570 |
| 7,038,385 | B2 * | 5/2006 | Takagaki et al. | 313/631 |
| 2003/0178940 | A1 | 9/2003 | Yoshida et al. | |

FOREIGN PATENT DOCUMENTS

| | | | |
|---|---|---|---|
| EP | 0275580 | A1 | 7/1988 |
| EP | 0570068 | A1 | 11/1993 |
| EP | 0647964 | B1 | 8/1997 |
| EP | 1156505 | A1 | 11/2001 |
| WO | 9634405 | | 10/1996 |
| WO | 03056607 | | 7/2003 |

OTHER PUBLICATIONS

International Standard, Lamps for Road Vehicles—Performance Requirements, CEI IEC 60810, Third Edition May 2003.

* cited by examiner

*Primary Examiner*—Ashok Patel

(57) ABSTRACT

The invention relates to a Hg free high pressure discharge lamp having a quartz envelope and a halide filling, wherein the lamp comprises at least one electrode which comprises tungsten and ≧0 wt. % and ≦0.5 wt. % thorium and whereby the lamp comprises at least one Mo-containing lead-in wire and/or foil whereby the Mo containing wire and/or foil comprises $TiO_2$ and having a characteristic life time of ≧2500 h and ≦7500 h according to the EU Carmaker cycle test.

9 Claims, 2 Drawing Sheets

LAMP WITH AN IMPROVED LAMP BEHAVIOUR

The invention relates to a lamp with an improved lamp behaviour during operation of the lamp.

Today's HID lamps for optical applications as projection or car head lighting are typically HID lamps consisting of a quartz envelope which is filled with a rare gas and mercury and often with a halide filling.

In today's lamps, especially HID-Lamps there have been increasing demands for the lamps to contain as less mercury as possible; preferably the lamps are to be mercury-free. However, when employing Hg-free or essentially Hg-free lamps of the state of the art, there is the danger, that due to the lack of mercury the lamp behaviour and features are deteriorated. This goes especially for the lifetime of the lamp and the long-time behaviour of the lamp.

There exist Hg free High pressure discharge lamps with reasonable long time behavior, which have a ceramic (Poly crystalline Alumina) envelop e.g. high pressure Sodium lamps. The drawback of these lamp class over lamps made with a quartz envelope is the light scattering behavior of the presently available poly crystalline Alumina ceramic. Therefore these lamps have disadvantages in optical applications, as projection or car head lighting.

There exist also Hg free High pressure discharge lamps with reasonable long time behavior, which have a quartz envelope and which have a pure Xe filling. The drawback of these lamp class over lamps made with a metal halide filling is their bad efficiency that means a low light output related to the electrical input power, which is at least two times lower than for modern metal halide discharge lamps.

Therefore it is an object to provide a lamp that has an improved lamp behaviour, especially concerning the life time and long-time behaviour of the lamp.

This object is achieved by a Hg free high pressure discharge lamp having a quartz envelope and a halide filling, wherein the lamp comprises at least one electrode which comprises tungsten and ≧0 wt.-% and 0.5 wt.-% thorium and whereby the lamp comprises at least one Mo-containing lead-in wire and/or foil whereby the Mo-containing wire and/or foil comprises $TiO_2$ and having a characteristic life time of ≧2500 h and ≦7500 h according to the EU Carmaker cycle test.

In the sense of the present invention, the characteristic lifetime is in particular the time after which 63.2% of the lamps have failed. This lifetime is preferably determined using a Weibull-Plot.

Hg-free in the sense of the present invention means that the filling of the lamp contains ≧0 mg and ≦0.5 mg, preferably ≦0.3 mg and most preferred ≦0.1 mg Hg.

A halide filling in the sense of the present invention means in particular that the filling of the lamp comprises at least one component which comprises one or more members of the group comprising fluorine, chlorine, bromine and iodine. Preferably the filling comprises iodine.

A quartz envelope in the sense of the present invention means in particular that the

- quartz envelope consists out of ≧95 wt.-% and ≦100 wt.-% $SiO_2$, and/or
- the quartz envelope forms a vacuum tight compartment for the lamp filling (in particular filling gas and/or salt filling) and/or the quartz envelope is in direct contact with this lamp filling (in particular filling gas and/or salt filling) and/or
- the quartz envelope contains in particular the lead-in wire and/or foil as electrical contact as described below.

The inventors have found out that by providing a Hg free high pressure discharge lamp as described above, which has an average life time of ≧2500 h and ≦7500 h according to the EU Carmaker cycle test, the requirements for modern applications for lamps are met. Preferably the characteristic life time of the lamp is ≧3000 h, more preferably ≧3500 h, most preferred ≧4000 h and ≦7500 h.

According to a preferred embodiment of the present invention the lamp comprises at least one electrode which comprises tungsten. Preferably the electrodes of the lamp are tungsten-based and comprise ≧70 wt.-% and ≦100 wt.-% tungsten.

According to a preferred embodiment of the present invention the lamp comprises at least one Mo-containing lead-in wire and/or foil. Mo-containing lead-in wires and/or foils are e.g. known from the EP 1 156 505 and/or EP 275 580.

According to a preferred embodiment of the present invention the lamp comprises at least one electrode which comprises ≧0 wt.-% and ≦0.5 wt.-% thorium. By using at least one electrode, preferably two electrodes, which comprise only a low thorium content, further life-time improvements of the lamp can be obtained without degradation of the other lamp characteristics. Preferably the lamp comprises at least one electrode which comprises ≧0 wt.-% and ≦0.3 wt.-%, more preferably ≦0.2 wt.-% and most preferred ≦0.1 wt.-% thorium. However, the electrode can comprise ≧0.0001 wt.-%, ≧0.0005 wt.-%, ≧0.001 wt.-%, ≧0.005 wt.-%, ≧0.01 wt.-%, ≧0.02 wt.-%, ≧0.04 wt.-%, ≧0.06 wt.-%, ≧0.08 wt.-% of thorium, based on the total weight amount of the electrode rod.

The electrode can be divided into two parts: a part which is embedded in the quartz envelope called shaft and a part facing into the quartz envelope called electrode head.

The electrode shaft, which is in form of an electrode rod, has an electrode rod diameter of 50 μm to 1000 μm, preferably of 100 μm to 500 μm, more preferred of 200 μm to 400 μm, most preferred 200 to 350 μm.

The length of the electrode rod up to the position where the electrode is joint or sandwiched with the inner discharge bulb of the burner, which is called electrode head, can be of 100 μm to 10000 μm, preferably 1000 μm to 5000 μm, and most preferably 1500 μm to 3500 μm.

The electrode head can have various geometrical shapes with a maximum diameter of 3000 μm more preferably of between 100 μm and 1000 μm most preferably between 200 μm and 450 μm.

The distance between the two opposed electrode tips is of at least 0.5 mm to about 15.0 mm, preferably of between 1.0 mm to 5.0 mm and more preferably of between 3.0 mm to 4.5 mm.

The high pressure discharge lamp is most preferably a high pressure mercury-free discharge lamp and said inert starting gas is preferably xenon.

According to a preferred embodiment of the present invention the filling of the lamp comprises at least one of the following components: Na, Sc, Xe, Zn, In, I. This can e.g. be achieved by using a filling that contains NaI and/or $ScI_3$ and/or $ZnI_2$ and/or InI and/or Xe.

Preferably the lamp-comprises the following amount per discharge vessel volume(=the concentration inside the lamp) for the following components:

- Na: 0.1 $\mu g/mm^3 \leqq Na \leqq 50\ \mu g/mm^3$, more preferably 0.5 $\mu g/mm^3 \leqq Na \leqq 5\ \mu g/mm^3$ and/or
- Sc: 0.1 $\mu g/mm^3 \leqq Sc \leqq 50\ \mu g/mm^3$, more preferably 0.2 $\mu g/mm^3 \leqq Sc \leqq 3\ \mu g/mm^3$ and/or Th: 0 $\mu g/mm^3 \leqq Th \leqq 1$ $\mu g/mm^3$ more preferably 0 $\mu g/mm^3 \leqq Th \leqq 0.5$ $\mu g/mm^3$ and most preferably 0 $\mu g/mm^3 \leqq Th \leqq 0.2$ $\mu g/mm^3$ and/or I: 1 $\mu g/mm^3 \leqq I \leqq 150$ $\mu g/mm^3$ more preferably 5 $\mu g/mm^3 < I < 50$ $\mu g/mm^3$.

This has already proven itself to be the optimum concentration borders for Sodium, Scandium, Thorium and/or Iodine to be used in a filling for a lamp according to the present invention.

Preferably the filling of the lamp is done under clean conditions in inert gas Ar atmosphere.

According to a preferred embodiment of the present invention the Mo-containing wire and/or foil comprises $TiO_2$ or is coated with $TiO_2$. Preferably, the Mo-containing wire and/or foil comprises ≧300 ppm $TiO_2$ and ≦2000 ppm $TiO_2$, more preferred ≧500 ppm $TiO_2$ and ≦1500 ppm $TiO_2$. Mo-containing wire and/or foil comprising $TiO_2$ can furthermore enhance the life-time and the performance characteristics of the lamp. However, the Mo-containing wire and/or foil can comprises ≧350 ppm $TiO_2$ and ≦1750 ppm $TiO_2$, more preferred ≧400 ppm $TiO_2$ and ≦750 ppm $TiO_2$. By doing so, the lamp features can be furthermore improved.

It is especially preferred, if the Mo-containing foil comprises $TiO_2$, the lamp filling and/or the electrodes of the lamp have only a low Th-content, as described above. This for the reason that the thorium compounds in the filling, e.g. $ThO_2$ tend to react with Iodine present in the filling to $ThI_4$. This $ThI_4$, however, then readily reacts, after diffusing out of the inner chamber of the lamp towards the Mo-containing lead-in wire or foil, with the $TiO_2$ present therein according to the following equation:

$$TiO_2 + ThI_4 \Rightarrow ThO_2 + TiI_4$$

This leads to deterioration of the Mo-containing foil and to degradation sometimes even malfunction of the lamp.

According to a preferred embodiment of the present invention the lamp comprises at least one electrode which comprises additional metals such as:

≧0 wt.-% and ≦0.5 wt.-% thorium, and/or

≧0 ppm and ≦1000 ppm K, preferably ≧1 ppm and ≦500 ppm K, further preferred ≧10 ppm and ≦250 ppm K, more preferred ≧25 ppm and ≦150 ppm K, and more preferred ≧50 ppm and ≦100 ppm K, and/or ≧0 ppm and ≦200 ppm Al, preferably ≧1 ppm and ≦100 ppm Al, further preferred ≧5 ppm and ≦70 ppm Al, more preferred ≧10 ppm and ≦50 ppm Al, and most preferred ≧15 ppm and ≦30 ppm Al, and/or ≧0 ppm and ≦500 ppm Si, preferably ≧1 ppm and ≦300 ppm Si, further preferred ≧10 ppm and ≦200 ppm Si, more preferred ≧25 ppm and ≦150 ppm Si, and most preferred ≧50 ppm and ≦100 ppm Si, and/or ≧0 ppm and ≦5 ppm Cr, preferably ≧0.05 ppm and ≦4 ppm Cr, further preferred ≧0.1 ppm and ≦3 ppm Cr, more preferred ≧0.5 ppm and ≦3 ppm Cr, and most preferred ≧1 ppm and ≦2 ppm Cr, and/or ≧0 ppm and ≦30 ppm Fe, preferably ≧1 ppm and ≦25 ppm Fe, further preferred ≧5 ppm and ≦20 ppm Fe, and most preferred ≧10 ppm and ≦15 ppm Fe, and/or ≧0 ppm and ≦10 ppm Ni, preferably ≧0.1 ppm and ≦8 ppm Ni, further preferred ≧0.5 ppm and ≦5 ppm Ni, and most preferred ≧1 ppm and ≦4 ppm Ni and/or ≧0 ppm and ≦5 ppm Cu, preferably ≧0.01 ppm and ≦4 ppm Cu, further preferred ≧0.05 ppm and ≦3 ppm Cu, more preferred ≧0.1 ppm and ≦2 ppm Cu, and most preferred ≧0.5 ppm and ≦1 ppm Cu, and/or ≧0 ppm and ≦500 ppm Mo, preferably ≧1 ppm and ≦300 ppm Mo, further preferred ≧5 ppm and ≦200 ppm Mo, more preferred ≧10 ppm and ≦100 ppm Mo and most preferred ≦20 ppm and ≦50 ppm Mo.

The above mentioned additional metals of the electrode in combination with the Mo-containing lead-in wire and/or foil, whereby the Mo-containing wire and/or foil comprises $TiO_2$, significant increases the life time of the lamp according to the present invention.

However, it is possible that the electrode can comprise ≦80 ppm K and/or ≦15 ppm Al and/or ≦50 ppm Si and/or ≦1 ppm Cr and/or ≦11 ppm Fe and/or ≦3 ppm Ni and/or ≦1 ppm Cu and/or ≦28 ppm Mo.

The discharge vessel of a lamp according to the present invention can have various hollow shapes, e.g substantially the form of a cylinder whereby the inner diameter of the discharge vessel is at most 20 mm, preferably 1 mm to 10 mm, further preferred at most 5 mm, more preferred 2 to 4 mm—the outer diameter of the discharge vessel is at most 30 mm, preferably 1 mm to 20 mm, further preferred at most 10 mm, more preferred 3 to 8 mm and most preferred 5.0 mm to 7.0 mm; and/or the length of the discharge vessel is at most 30 mm, preferably 1 mm to 20 mm, further preferred at most 15 mm, more preferred 5 to 10 mm and most preferred 7 mm to 9 mm.

According to a preferred embodiment of the present invention the inner cold pressure of the lamp is $\geqq 0.5 \times 10^5$ Pascal and $\leqq 30 \times 10^5$ Pascal, preferably $\geqq 5 \times 10^5$ Pascal and $\leqq 15 \times 10^5$ Pascal.

A lamp according to the present invention is being designed for the usage in various systems and/or applications, amongst them: shop lighting, home lighting, car-head lamps or other car lighting, accent lighting, spot lighting, theater lighting, consumer TV applications, fiber-optics applications, and projection systems.

The aforementioned components, as well as the claimed components and the components to be used in accordance with the invention in the described embodiments, are not subject to any special exceptions with respect to their size, shape, material selection and technical concept such that the selection criteria known in the pertinent field can be applied without limitations.

Additional details, characteristics and advantages of the object of the invention are disclosed in the subclaims and the following description of the respective figures and examples—which in an exemplary fashion—show two examples of a HID lamp according to the invention.

EXAMPLE 1

Six samples of a HID lamp according to the invention were used for lifetime measurement, the HID lamps each having the following composition and configuration:

Electrodes:

electrode diameter=300 μm, rod shape, comprising:

80 ppm K and
15 ppm Al and
≦50 ppm Si and
≦1 ppm Cr and
≦11 ppm Fe and
≦3 ppm Ni and ≦1 ppm Cu and
≦28 ppm Mo.

Mo-foil:
$TiO_2$ coated Mo-foil, comprising:
1400 ppm $TiO_2$

Salt filling
NaI, $ScI_3$, InI, $ZnI_2$, $ThI_4$, comprising:
NaI: 250 μg
$ScI_3$: 89 μg
InI: 2.5 μg
$ZnI_2$: 17 μg
$ThI_4$: 10 μg Discharge Vessel
Inner Diameter: 2.7 mm
Outer diameter: 6.1 mm
Vessel length: 7.4 mm
Cylindrical Shape
Inner Cold Pressure
$10\times10^5$ Pascal The filling of the lamp was done under clean conditions in inert gas Ar atmosphere. The HID lamps are produced as described in Patent WO 96/34405. The HID lamps are covered with an outer bulb as described in Patent EP 0 0570 068 B1, claim 4 and claim 6.

Figure 1:
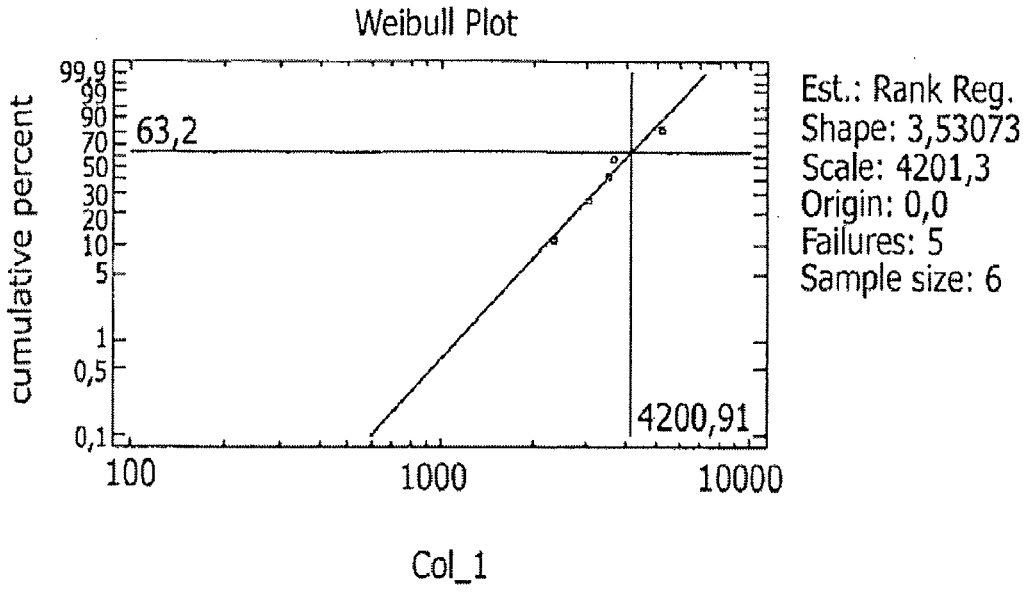
FIG. 1 shows a Weibull-Plot of a first example of a HID lamp according to the invention.

From the samples, the characteristic lifetime was measured to be $T_c$=4200 h using the Weibull-Plot as shown in FIG. 1

EXAMPLE 2

Six samples of a HID lamp according to the invention were used for lifetime measurement, the HID lamps each having the following composition and configuration:

Electrodes:
electrode diameter=300 μm, rod shape, comprising:
80 ppm K and
15 ppm Al and
≦50 ppm Si and
≦1 ppm Cr and
≦11 ppm Fe and
≦3 ppm Ni and
≦1 ppm Cu and
≦28 ppm Mo.

Mo-foil:
$TiO_2$ coated Mo-foil, comprising:
1400 ppm $TiO_2$

Salt filling
NaI, $ScI_3$, InI, $ZnI_2$, $ThI_4$, comprising:
NaI: 185 μg
$ScI_3$: 57 μg
InI: 2.5 μg
$ZnI_2$: 17 μg Discharge vessel
Inner diameter: 2.7 mm
Outer diameter: 6.1 mm
Vessel length: 7.4 mm
Cylindrical Shape
Inner Cold Pressure
$10\times10^5$ Pascal The filling of the lamp was done under clean conditions in inert gas Ar atmosphere.

Figure 2:
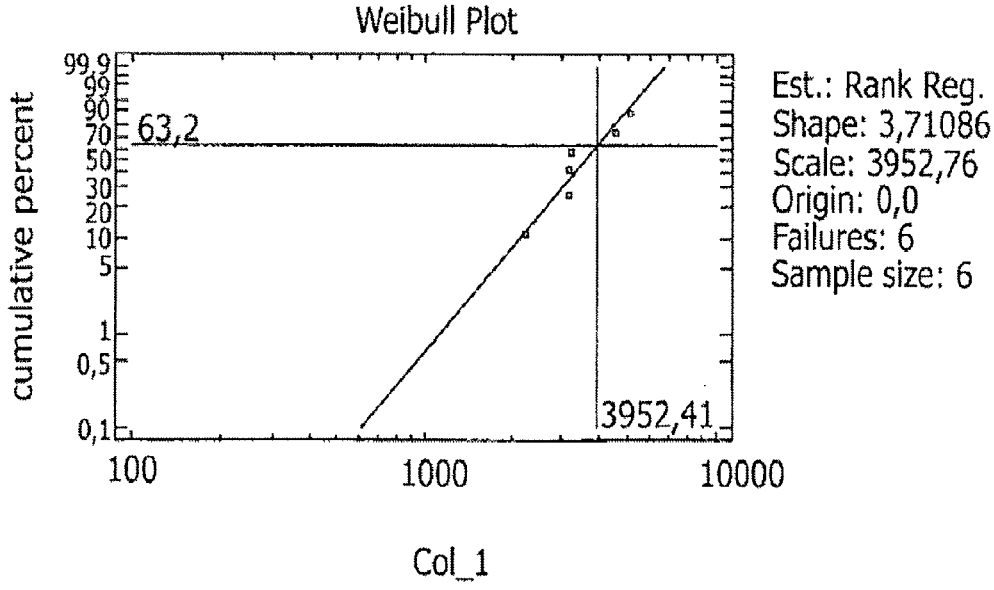
FIG. 2 shows a Weibull-Plot of a second example of a HID lamp according to the invention.

From the samples, the characteristic lifetime was measured to be $T_c$=3950 h using the Weibull-Plot as shown in FIG. 2

Measuring Methods:

The lifetime of the lamp was measured according to the EU-Carmaker cycle test.

The European carmaker Cycle is described in the official norm of the International Eletrotechnical Commission IEC 60810 Ed3 "Lamps for road vehicles—performance requirements" in Appendix D.4.

Figure 3:
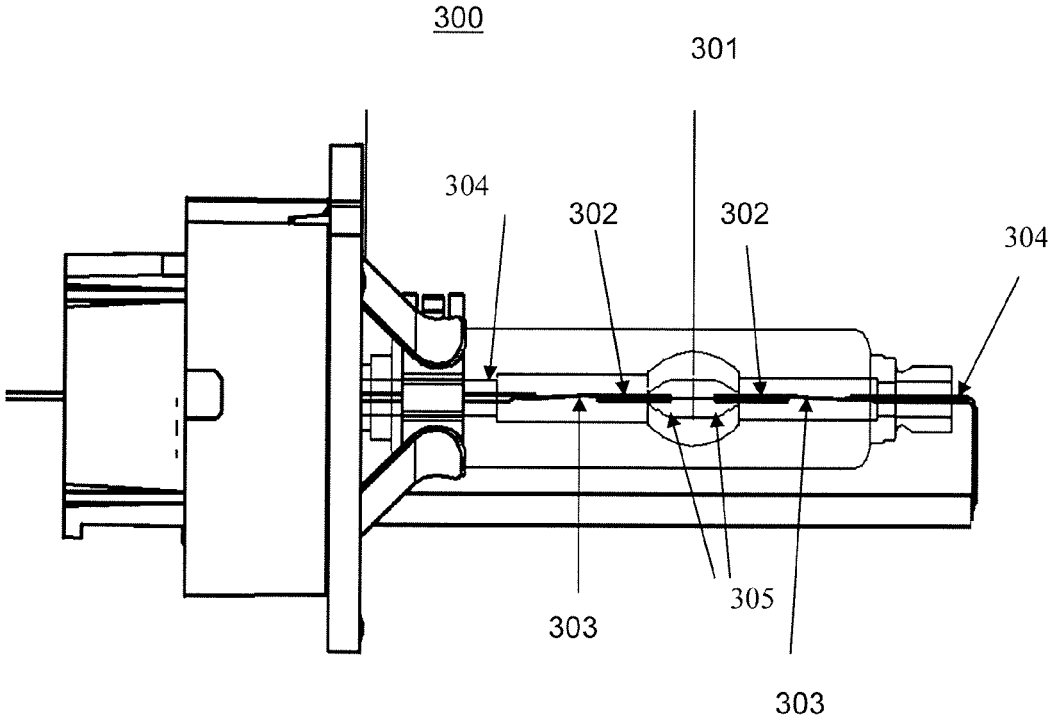
FIG. 3 shows a cross-sectional view of a lamp in accordance with a representative embodiment.

FIG. 3 shows cross-sectional view of a lamp 300 in accordance with a representative embodiment. The lamp 300 comprises a discharge vessel 301. Electrodes 302 comprising Tungsten (W) and Thorium in concentrations described below are connected to the discharge vessel 301. Foils 303 comprising molybdenum (Mo) are connected to the electrodes 302. Lead-in wires 304 also comprising Mo are connected to respective foils 303. The electrodes 302 each comprise ≧0 wt.-% and ≦0.5 wt.-% thorium in one embodiment. The electrodes 302 comprise a comparatively low thorium content, which provides life-time improvements of the lamp 300 without degradation of the other lamp characteristics. Preferably the lamp comprises at least one electrode which comprises ≧0 wt.-% and ≦0.3 wt.-%, more preferably ≦0.2 wt.-% and most preferred ≦0.1 wt.-% thorium. However, the electrode can comprise ≧0.0001 wt.-%, ≧0.0005 wt.-%, ≧0.001 wt.-%, ≧0.005 wt.-%, ≧0.01 wt.-%, ≧0.02 wt.-%, ≧0.04 wt.-%, ≧0.06 wt.-%, ≧0.08 wt.-% of thorium, based on the total weight amount of the electrode rod.

The electrodes 302 are shown with opposing tips 305 across the discharge vessel 301. The distance between the two opposed electrode tips is of at least 0.5 mm to about 15.0 mm, preferably of between 1.0 mm to 5.0 mm and more preferably of between 3.0 mm to 4.5 mm. Each electrode 302 comprises an electrode shaft, which is in form of an electrode rod, having an electrode rod diameter of 50 μm to 1000 μm, preferably of 100 μm to 500 μm, more preferred of 200 μm to 400 μm, most preferred 200 to 350 μm.

The characteristic lifetime is the time after which 63.2% of the lamps have failed. This is preferably determined by a Weibull-Plot (as shown in the Examples).

The invention claimed is:

1. A Hg free high pressure discharge lamp having a quartz envelope and a halide filling, comprising:
at least one electrode which comprises tungsten and 0.0001% and ≦0.5 wt.-% thorium; and
at least one lead-in wire comprising molybdenum (Mo) and $TiO_2$, or a foil comprising Mo and $TiO_2$, or both.

2. Lamp according to claim 1, wherein the electrode comprises an electrode rod comprising a diameter of 50 μm to 1000 μm.

3. Lamp according to claim 1, whereby the length of the electrode rod up to a position where the electrode is connected to an inner discharge bulb of an electrode head is in the range of 100 μm to 10000 μm, or the electrode head has a maximum diameter of 3000 μm, or both.

4. Lamp according to claim 1, wherein each electrode comprises and electrode tip and a distance between two opposing electrode tips is of at least 0.5 mm and as great as approximately 15.0 mm.

5. Lamp according to claim 1, whereby the filling of the lamp comprises at least one of the following components: Na, Sc, Xe, Zn, In, I.

6. Lamp according to claim 1, wherein the lead-in wire, or the foil, or both, comprises ≧300 ppm $TiO_2$ and ≦2000 ppm $TiO_2$.

7. Lamp according to claim 1 whereby the lamp comprises at least one electrode which comprises: ≧0 ppm and ≦1000 ppm K and/or ≧0 ppm and ≦200 ppm Al and/or ≧0 ppm and ≦500 ppm Si and/or ≧0 ppm and ≦5 ppm Cr and/or ≧0 ppm and ≦30 ppm Fe and/or ≧0 ppm and ≦10 ppm Ni and/or ≧0 ppm and ≦5 ppm Cu and/or ≧0 ppm and ≦500 ppm Mo.

8. The lamp according to claim 1, whereby the inner cold pressure of the lamp is $0.5\times10^5$ Pascal and $\leqq 20\times10^5$ Pascal.

9. The lamp according to claim 1, whereby the concentration of sodium inside the lamp is 0.1 μg/mm.sup.3<Na<50 μg/mm.sup.3, and/or a concentration of scandium inside the lamp is Sc: 0.1 $\mu g/mm^3 < Sc < 50\ \mu g/mm^3$, or the concentration of iodine inside the lamp is 1 $\mu g/mm^3 < I < 150\ \mu g/mm^3$, or both.

* * * * *